US007802827B2

(12) United States Patent
Easterday et al.

(10) Patent No.: US 7,802,827 B2
(45) Date of Patent: Sep. 28, 2010

(54) CLOSING RING FOR LID AND CONTAINER COMBINATION

(75) Inventors: Dyke T. Easterday, Auburn, IN (US); Mark E. Scheibelhut, Auburn, IN (US); Thomas Triner, St. Louisville, OH (US); Thomas P. Kasting, Ft. Wayne, IN (US)

(73) Assignee: Rieke Corporation, Auburn, IN (US)

( * ) Notice: Subject to any disclaimer, the term of this patent is extended or adjusted under 35 U.S.C. 154(b) by 1103 days.

(21) Appl. No.: 11/268,379

(22) Filed: Nov. 7, 2005

(65) Prior Publication Data

US 2007/0102941 A1 May 10, 2007

(51) Int. Cl.
*B65D 45/00* (2006.01)

(52) U.S. Cl. ..... 292/256; 292/256.3; 292/319; 292/256.6; 292/256.9; 220/321

(58) Field of Classification Search ..... 292/256.6, 292/256.9, 256.3, 299; 220/287, 320, 321 X, 220/319; 24/273
See application file for complete search history.

(56) References Cited

U.S. PATENT DOCUMENTS

| | | | | | |
|---|---|---|---|---|---|
| 1,482,049 | A | * | 1/1924 | Swanson | 220/321 |
| 3,246,793 | A | * | 4/1966 | Wade | 220/321 |
| 3,889,852 | A | | 6/1975 | Strefford | 222/153 |
| 3,897,884 | A | | 8/1975 | Lankenau | 220/320 |
| 3,997,072 | A | | 12/1976 | Guth | 220/1 T |
| 4,033,454 | A | | 7/1977 | Santoni | 206/386 |
| 4,101,156 | A | * | 7/1978 | Santoni | 292/256.69 |
| 4,205,761 | A | | 6/1980 | Gerster | 220/321 |
| 4,294,377 | A | | 10/1981 | Chen | 220/321 |
| 4,350,031 | A | | 9/1982 | Shimono | 70/315 |
| 4,955,504 | A | | 9/1990 | Lesscher | 220/352 |
| 5,020,839 | A | | 6/1991 | Kalb | 292/256.69 |

(Continued)

FOREIGN PATENT DOCUMENTS

DE 1181623 B1 11/1964

(Continued)

OTHER PUBLICATIONS

European Search Reported dated Jan. 22, 2008 issued in Appln. No. EP 07253425.8.

(Continued)

*Primary Examiner*—Peter M. Cuomo
*Assistant Examiner*—Mark Williams
(74) *Attorney, Agent, or Firm*—Woodard, Emhardt, Moriarty, McNett & Henry LLP

(57) ABSTRACT

A closing ring for a container and lid combination for securing the lid to the container includes a ring body having first and second free ends to be drawn together in order to secure the lid to the container. A link clevis and a lever clevis are welded to the free ends. A link is pivotally connected to the link clevis. A lever is pivotally connected to the lever clevis. The linkage arrangement is completed by connecting the link to the lever at a third pivot connection. A movable locking projection is assembled to the lever clevis for engaging the lever during an opening attempt wherein this engaging prevents the opening of the ring body until the movable locking projection is moved out of its engaging position relative to the lever.

14 Claims, 9 Drawing Sheets

U.S. PATENT DOCUMENTS

| | | | | | |
|---|---|---|---|---|---|
| 5,129,537 | A | * | 7/1992 | Bordner et al. | 220/321 |
| 5,219,088 | A | | 6/1993 | Reina | 220/321 |
| 5,284,270 | A | | 2/1994 | Kusta | 220/321 |
| 5,295,604 | A | | 3/1994 | Van Ryswyk | 220/321 |
| 5,299,707 | A | | 4/1994 | Stolzman | 220/321 |
| 5,411,162 | A | | 5/1995 | Koziczkowski et al. | 220/320 |
| 5,713,482 | A | | 2/1998 | Bordner et al. | 220/321 |
| 5,947,320 | A | | 9/1999 | Bordner et al. | 220/321 |
| 6,007,120 | A | | 12/1999 | Vogt et al. | 292/256.69 |
| 6,435,576 | B1 | | 8/2002 | Kusta | 292/256.67 |
| 6,540,097 | B1 | | 4/2003 | Beck et al. | 220/321 |

FOREIGN PATENT DOCUMENTS

| | | | | |
|---|---|---|---|---|
| DE | 2039548 | A1 | | 2/1972 |
| DE | 7512896 | U | | 2/1977 |
| DE | 8806922 | U1 | | 9/1989 |
| DE | 39 24 594 | A1 | | 2/1991 |
| DE | 3933995 | A1 | * | 4/1991 |
| EP | 0 499 191 | A1 | | 8/1992 |
| EP | 563567 | A1 | * | 10/1993 |
| EP | 1 325 873 | A2 | | 7/2003 |
| EP | 1 325 873 | A3 | | 7/2003 |
| EP | 1783062 | A2 | * | 5/2007 |
| WO | WO 02/20365 | A1 | | 3/2002 |

OTHER PUBLICATIONS

Rieke Packaging Systems, Drum Catalog, pre-Jan. 1, 2005, 7 pgs.
Rieke Packaging Systems Brochure, pre-Jan. 1, 2004, 3 pgs.
Rieke Packaging.com, Rieke Packaging Systems, TOV Rings, 2 pgs.

* cited by examiner

CLOSING RING FOR LID AND CONTAINER COMBINATION

BACKGROUND OF THE INVENTION

The present invention relates in general to a closing ring for open head drum-styled containers. Containers of the type disclosed herein may range from the smaller pail sizes of approximately 1 gallon up to much larger industrial drum sizes. The closing ring is used to securely attach a matching closing lid to the open end of the container. Containers of the type disclosed herein, formed as generally cylindrical structures with an upper, generally circular open end, are closed by tightly securing a matching lid over the open end of the container. The lid edge and container lip edge are clamped together by the closing ring. It is important to tightly connect the lid to the container in order to close and seal in the container contents and prevent any loss or leakage of those contents. The closing ring is used in cooperation with the lid and container structures for this purpose.

Since the entire contents of the container may not always be dispensed when the drum (container) is first opened after initial filling, it is important to be able to re-close the container with the matching lid with the same degree of security and tightness that was achieved at the time of initial filling and closing. Presently, the two most commonly-used closing ring structures employ either a tightening bolt arrangement or an over-center lever and linkage arrangement. The bolt arrangement requires manual tightening and untightening of the bolt into or out of a nut or at least an internally-threaded block. The torque applied to the bolt and the relative sizing of the ring body relative to the diameter of the lid dictate the degree of tightness and thus the security of the lid-to-container connection. Once the lid is securely tightened onto the container by this bolt arrangement, it remains in position and is generally not at risk of loosening or coming apart. Perhaps the only risk in terms of loosening is due to vibration during shipment. The benefit of normally remaining tightly secured is offset by the time required to open and close the ring and thereby be able to remove or reapply the lid.

The over-center lever and linkage arrangement uses a linkage with multiple pivots and a lever handle that is folded to close the container and unfolded or pivoted outwardly to be able to open the container. The lever handle in cooperation with the pivot points and linkage members makes use of the mechanical advantage and leverage of the structure to enable a tight closing operation, while still being done manually. By enabling the manual folding of the lever handle to apply a sufficient clamping force by means of the closing ring to properly secure the lid to the container, the time required to unthread or thread the clamping bolt of the other configuration is eliminated. The tighter the clamping force applied by the closing ring, the greater the level of manual force that must be applied to the lever handle.

Prior to the present invention, in order to actually secure this lever and linkage style of closing ring in its closed condition, it was necessary to apply some external accessory such as a locking pin or tie. This type of accessory needs to be manually applied when the container is filled and closed and then removed at the time of initial dispensing. If the contents are not dispensed completely from the container after initial opening, and if there is some risk that the closing ring would inadvertently open, then the selected locking pin or tie would need to be reassembled, perhaps using a new one, and the process would then repeat itself whenever the container was opened on subsequent occasions. Whether done once or multiple times, this particular approach represents a time investment that would offset some of the benefits derived from the simplicity of the fold-to-close (over-center) lever and linkage arrangement. The concern is that without some type of securing or locking feature, the lever handle can be inadvertently flipped over to an open condition. This could occur unintentionally or it could occur inadvertently if the lever handle is caught or hooked on some other structure. This is possible during handling, loading, shipping, storage, etc. It would therefore be an improvement to this current state of the art in container closing rings to be able to retain the reliability and simplicity of the fold-to-close linkage but add a simple and effective securing or locking feature to prevent unintentional or inadvertent opening of the closing ring. The objective is to preclude the need for any hand tool or other implement and to eliminate the use of any add-on or extra component part or accessory. While these benefits are being achieved, the simplicity, strength, and reliability of the lever and linkage arrangement should not be compromised. As disclosed herein, the present invention includes an effective securing or locking feature as part of a simple, strong, and reliable closing ring construction.

BRIEF SUMMARY OF THE INVENTION

A closing ring for a container and lid combination for securing the lid to an open end of the container according to one embodiment of the present invention comprises a ring body having a first free end and a second free end, wherein the first and second free ends are drawn toward each other as part of manipulating the closing ring to secure the lid to the container, a lever pivotally connected at a first end to the first end of the ring body at a first pivot axis, the lever being constructed and arranged for opening and closing the ring body by pivoting about the first pivot axis, a link pivotally connected at a first end to the second end of the ring body and pivotally connected at a second end to the lever, and a movable projection assembled to the first end of the ring body, the movable projection being constructed and arranged for engaging the lever during an opening attempt, said engaging preventing opening of the ring body until the movable projection is moved out of its engaging position with the lever.

One object of the present invention is to provide an improved closing ring for a container and lid combination.

Related objects and advantages of the present invention will be apparent from the following description.

DETAILED DESCRIPTION OF THE INVENTION

Figure 1:
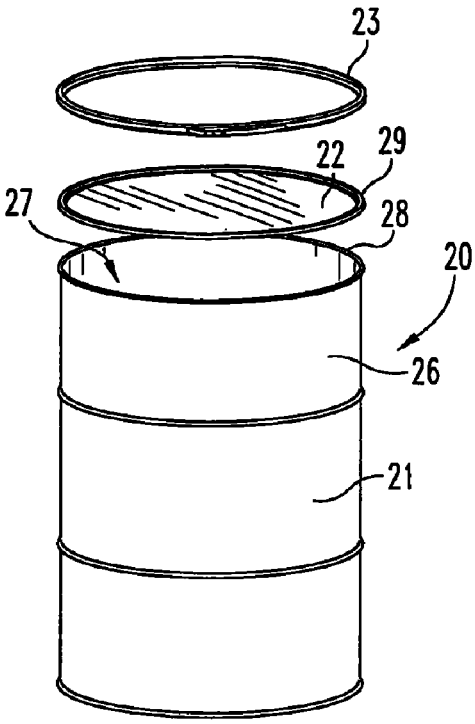
FIG. 1 is an exploded, perspective view of a closing ring, container, and lid according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2A:
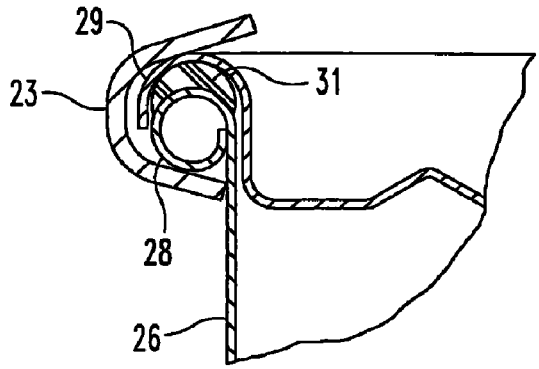
FIG. 2A is an enlarged, partial detail of the FIG. 1 closing ring as assembled to the FIG. 1 container and lid.
Figure 2B:
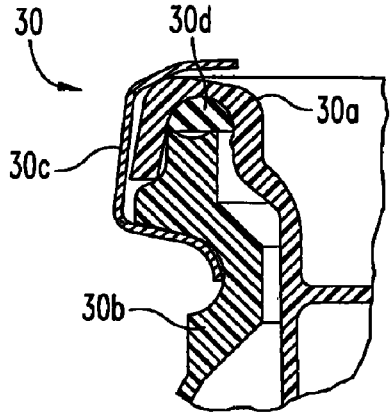
FIG. 2B is an enlarged, partial side elevational view, in full section, of the FIG. 1 closing ring as applied to a plastic container and lid combination.

Referring to FIGS. 1, 2A and 2B, there is illustrated a container assembly 20 that includes an open-end drum-styled container 21, closed by a generally-circular matching lid 22 in cooperation with a closing ring 23. The closing ring 23 is a subassembly of multiple component parts that are in part welded together and in part pivotally connected or pinned, preferably by rivets, so as to pivot about the longitudinal axis of those rivets, as described herein. The sidewall 26 of container 21 includes a generally cylindrical, upper opening 27 surrounded by lip edge 28. Opening 27 provides access to the contents that are placed (filled) into container 21. The matching lid 22 is generally circular and includes a peripheral lip edge 29 that is constructed and arranged to interfit or otherwise cooperate with lip edge 28 as illustrated in FIG. 2A. After the lid 22 and container 21 are assembled together, the closing ring 23 is applied and positioned so as to fit on, over, and around the abutting edges 28 and 29. An annular sealing gasket 31 may be used and, if used, is positioned as illustrated in FIG. 2A. The edge-to-edge abutment, interfit, or cooperation of edges 28 and 29 for the metal construction is diagrammatically illustrated in FIG. 2A. The edge-to-edge abutment, interfit, or cooperation for a plastic pail is diagrammatically illustrated in FIG. 2B. Pail 30 includes lid 30*a*, pail body 30*b*, closing ring 30*c*, and annular sealing gasket 30*d*. For the description of the preferred embodiment and any alternate embodiments, the FIG. 2A metal construction has been selected. This metal construction corresponds to what is illustrated in FIG. 1.

Figure 3:
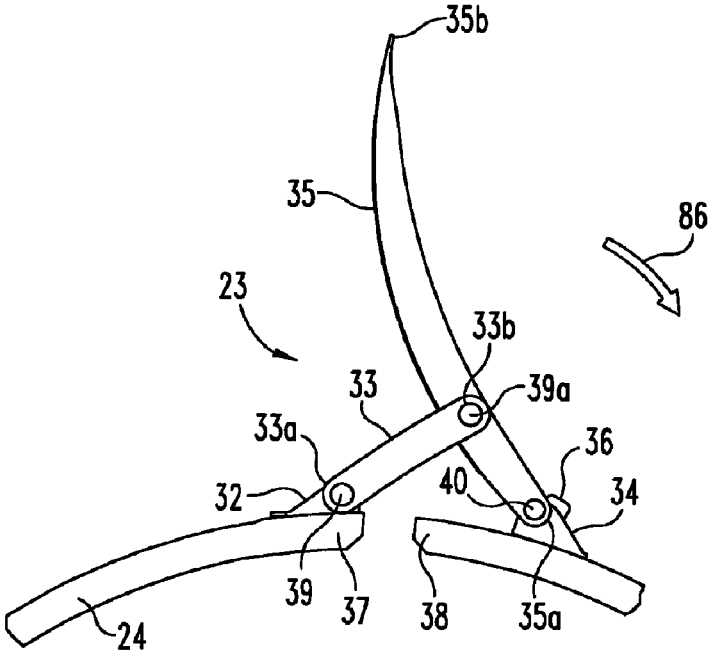
FIG. 3 is a partial, top plan view of the FIG. 1 closing ring in an open condition.
Figure 4:
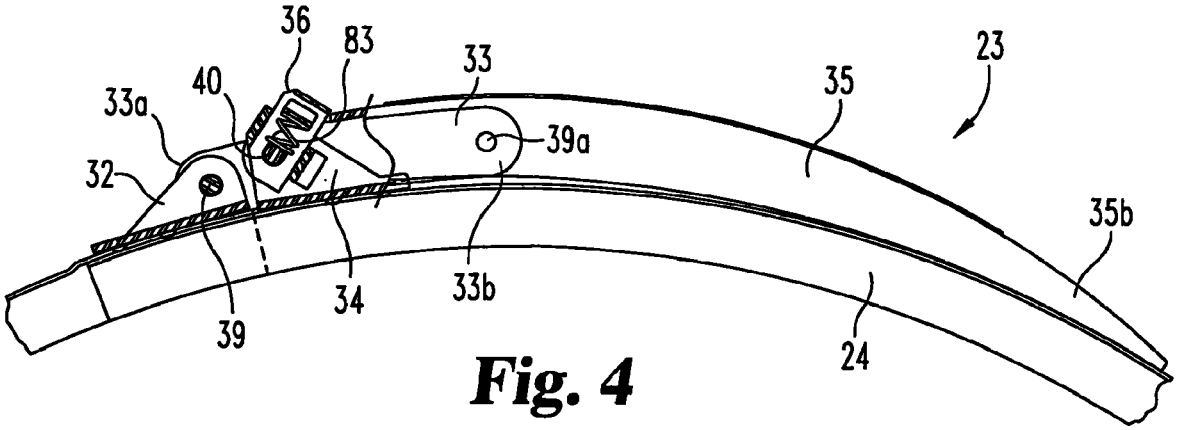
FIG. 4 is a partial, top plan view, in partial section, of the FIG. 1 closing ring in a closed condition.

Referring to FIGS. 3 and 4, the structural details of closing ring 23 are illustrated. Closing ring 23, which as described herein is an assembly or subassembly, includes the ring body 24, link clevis 32, two shorter links 33, lever clevis 34, lever 35, and push button release housing 36. Clevis 32 is welded to one free end 37 of ring body 24 and clevis 34 is welded to the opposite free end 38 of ring body 24. Each link 33 is pivotally connected (pinned) at end 33*a* to clevis 32 by means of rivet 39. As would be understood, each link 33, once secured to link clevis 32 by rivet 39, is able to pivot about the longitudinal axis of rivet 39. End 33*b* of each link 33 is pivotally connected (pinned) to lever 35 by a second rivet 39*a*, as illustrated in FIG. 3. Once again, as would be understood, each link 33 is able to pivotally move relative to lever 35 and lever 35 is able to pivot relative to each of the two links 33 about the longitudinal axis of rivet 39*a*. Lever 35 is pivotally connected (pinned) at end 35*a* to clevis 34 by means of a shorter rivet 40. Consistent with the foregoing description, lever 35 is able to pivot about the longitudinal axis of rivet 40. The various component parts that have been illustrated for the closing ring 23 assembly are illustrated in FIGS. 5-18.

The push button release housing 36 cooperates with lever 35 and lever clevis 34 in order to incorporate into the closing ring 23 a snap-closed, push button release feature that enables locking or securing the lever 35 in a closed condition. In terms of semantics, the lever 35 is not "locked" in the sense of a lock and key system or combination. However, the lever 35 is secured such that it will not open or unlatch until the push button release housing 36 is moved out of the way, by being pushed inwardly, such that there is no further abutment between the sidewall of the push button release housing and the edge of the receiving aperture as defined by lever 35. As will be described herein, opening of ring 23 requires that the push button release housing 36 be depressed (pushed inwardly) so that the lever 35 can be released by pivoting the lever to an open or unlatched position. In the closed condition, the free ends 37 and 38 telescope together and slide to reduce the circumference of ring body 24. In the open condition, the free ends 37 and 38 are spaced apart. A return spring 43 restores the push button release housing 36 to its extended condition once released from manual depression for the purposes of unlocking the lever.

Figure 5:
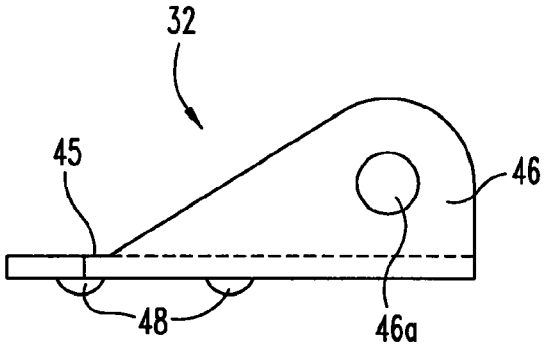
FIG. 5 is a front elevational view of a link clevis comprising one part of the FIG. 1 closing ring.
Figure 6:
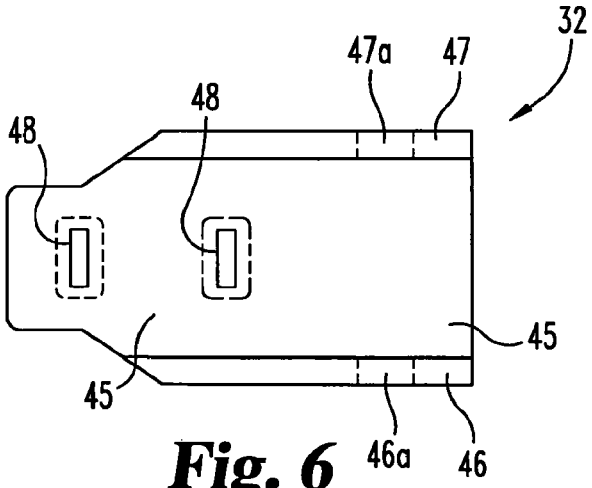
FIG. 6 is a top plan view of the FIG. 5 link clevis.
Figure 7:
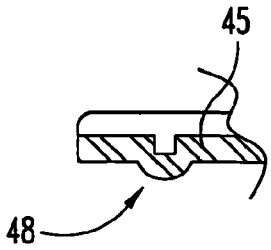
FIG. 7 is an enlarged, front elevational view, in full section, of a resistance weld projection comprising a portion of the FIG. 5 link clevis.

Referring now to FIGS. 5, 6, and 7, the details of link clevis 32 are illustrated. Link clevis 32 is a unitary, metal component that includes a base 45 and opposing and spaced-apart sides 46 and 47. A clearance hole 46*a* is defined by side 46 and an aligned clearance hole 47*a* is defined by side 47. Aligned holes 46*a* and 47*a* receive rivet 39. The base 45 is formed with a pair of resistance weld projections 48 that melt during the welding operation to aid in rigidly and securely attaching link clevis 32 to free end 37 of ring body 24. The orientation of link clevis 32, as it is welded to end 37, is illustrated in FIGS. 3 and 4. Sides 46 and 47 are set at the desired spacing or separation for the desired spacing for the two links 33. In terms of a drawing convention for the component parts and the closing ring 23 assembly, the component parts are oriented as a separate, free-standing part. Therefore, FIG. 5, for example, is a front elevational view. However, when this part is assembled into closing ring 23 and the ring is applied to the lid and container, this part changes to a top plan view orientation, due to how the container is oriented.

Figure 8:
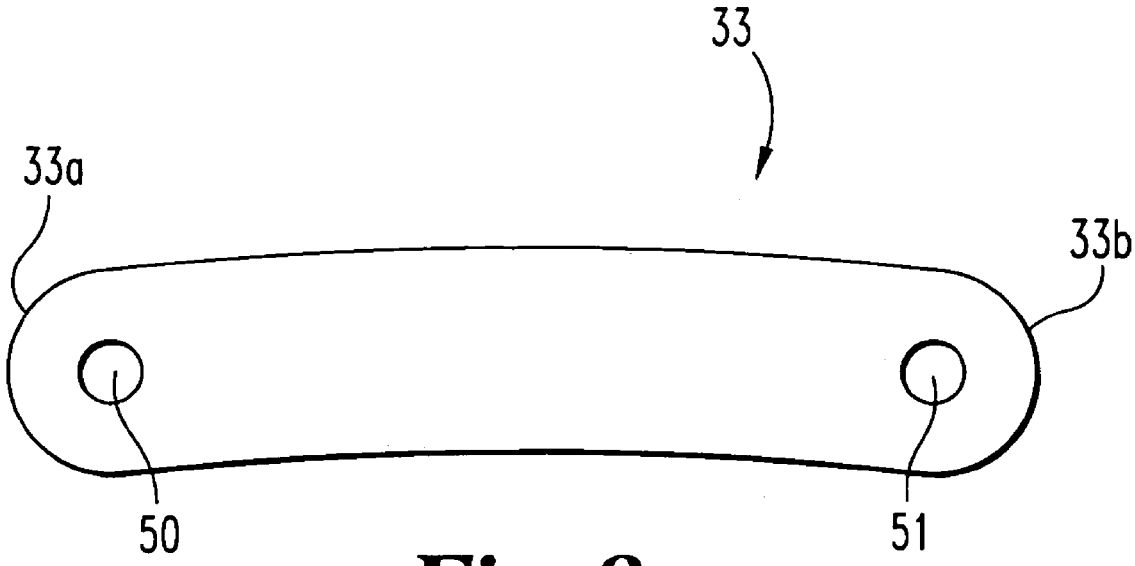
FIG. 8 is a front elevational view of a link comprising a portion of the FIG. 1 closing ring.
Figure 9:
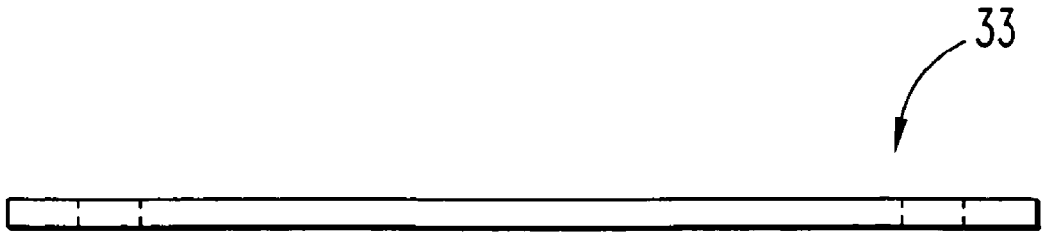
FIG. 9 is a top plan view of the FIG. 8 link.

Referring to FIGS. 8 and 9, each link 33 is a substantially flat, unitary metal plate with a slight curvature to its outer periphery. Its length between its two pivot points (50 and 51) is selected based upon the pivot point connection locations for the linkage and the need to be able to open the closing ring 23 a sufficient amount to remove the lid 22 from container 21. With regard to this particular relationship, putting those pivot point locations farther apart would equate to generating more clearance. However, the length is also a factor in determining how tightly the closing ring body 23 will clamp the lid 22 to the container 21. For this particular part of the overall operation, a shorter length would equate to a tighter clamping force, but it would also equate to requiring more manual force on lever 35 in order to move it to a closed condition, as is illustrated in FIG. 4.

Each link 33 defines a first rivet hole 50 at end 33*a* and a second rivet hole 51 at end 33*b* (see FIG. 8). Rivet hole 50 on one link 33 is aligned with hole 46*a*. Rivet hole 50 on the other link 33 is aligned with hole 47*a*. Once all four holes are aligned with each other, the rivet 39 is inserted through the four holes and then headed at its straight end to complete this phase of the assembly procedure in order to create this pivot point location. The spacing created for the two links 33, by way of the spacing between sides 46 and 47 of clevis 32, corresponds to the spacing required for the two links 33 to properly span the width or thickness of lever 35.

Referring now to FIGS. 10-13, the details of lever clevis 34 are illustrated. Clevis 34 is a unitary, metal component that includes a base 54, opposing, spaced-apart sides 55 and 56, closing panels 57 and 58, and inner walls 59 and 60. The starting shape of clevis 34 includes the portions that are formed in order to create sides 55 and 56, panels 57 and 58, and inner walls 59 and 60. Panels 57 and 58 and walls 59 and 60 cooperate to define a receiving pocket or chamber 61 for the push button release housing 36. The base 54 is formed with a pair of resistance weld projections 62 that melt during the welding operation to aid in rigidly and securely attaching lever clevis 34 to the free end 38 of ring body 24, see FIG. 3. Sides 55 and 56 each define a corresponding clearance hole 55*a* and 56*a*, respectively. These two holes are aligned and cooperate with lever 35 to establish a pivot point connection for lever 35 by way of rivet 40, see FIG. 4.

Figure 16:
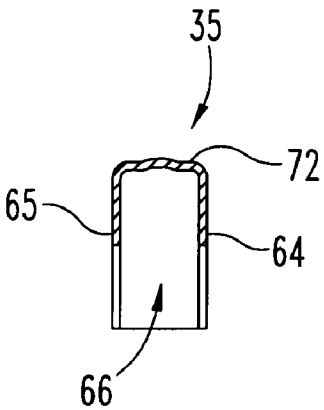
FIG. 16 is an end elevational view, in full section, of the FIG. 14 lever.
Figure 14:
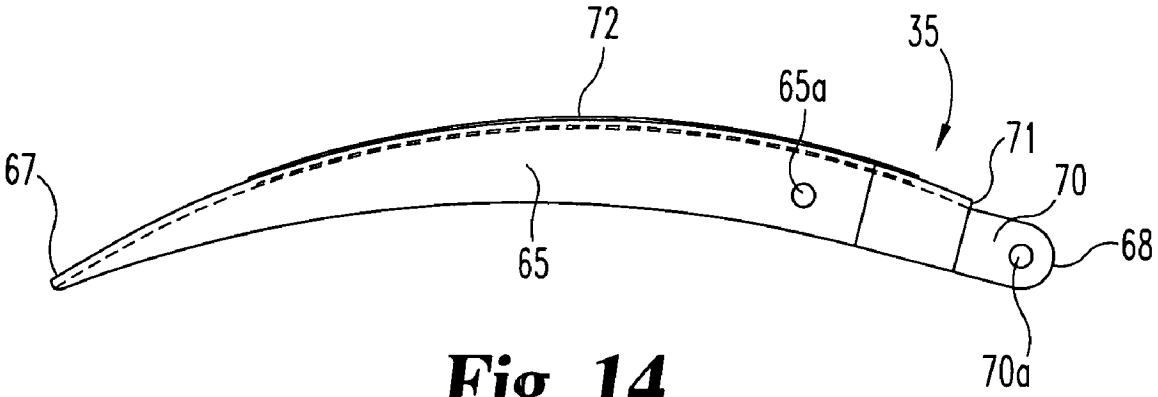
FIG. 14 is a front elevational view of a lever comprising a portion of the FIG. 1 closing ring.
Figure 15:
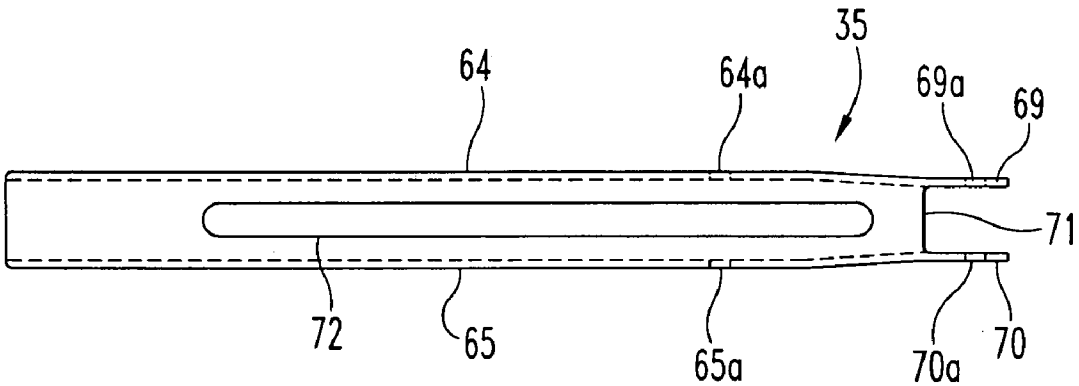
FIG. 15 is a top plan view of the FIG. 14 lever.

Referring now to FIGS. 14-16, the details of lever 35 are illustrated. Lever 35 is a unitary, formed metal structure that is shaped with opposing side panels 64 and 65 that define interior clearance space 66. End 67 is tapered while the opposite end 68 has a clevis configuration defined by sides 69 and 70 that extends beyond the edge 71 of outer panel 72. Sides 69 and 70 assemble over lever clevis 34 such that side 69 slides against side 55 and side 70 slides against side 56. Side 69 defines rivet hole 69*a* and aligned therewith, side 70 defines rivet hole 70*a*. When lever 35 is properly assembled onto and aligned with clevis 34, holes 55*a*, 56*a*, 69*a*, and 70*a* are all aligned in a substantially straight, axial line. These four holes receive rivet 40 and, once the rivet is inserted, its straight end is headed in order to secure this pivot point connection together, see FIGS. 3 and 4. Side panel 64 defines pivot hole 64*a* and side panel 65 defines pivot hole 65*a* that is actually aligned with pivot hole 64*a*. End 33*b* of each link 33 connects to lever 35 at the location of holes 64*a* and 65*a*. One link 33 is positioned against the outer surface side panel 64 while the other link 33 is positioned against the outer surface of side panel 65. Once both holes 51 and holes 64*a* and 65*a* are axially aligned, rivet 39*a* is inserted. The straight end of rivet 39*a* is headed in order to secure together the two links 33 and lever 35 at this pivot point connection location.

As would be understood, once rivets 39, 40, and 39*a* are each properly inserted through their corresponding set of aligned holes, a longitudinal pivot axis is created through the center of each rivet, as would be understood from the described construction and from the illustrations of FIGS. 3 and 4. The two links 33 are able to pivot about the pivot axis defined by rivet 39 relative to link clevis 32 and end 37. In a similar manner, lever 35 is able to pivot about the longitudinal axis defined by rivet 40 relative to lever clevis 34 and end 38. The final pivot point location for this linkage is at the location of rivet 39*a* that connects the two links 33 with lever 35. In this instance, the links are able to pivot relative to lever 35 and lever 35 is able to pivot relative to each of the two links about the longitudinal axis line defined by rivet 39*a*.

Figure 17:
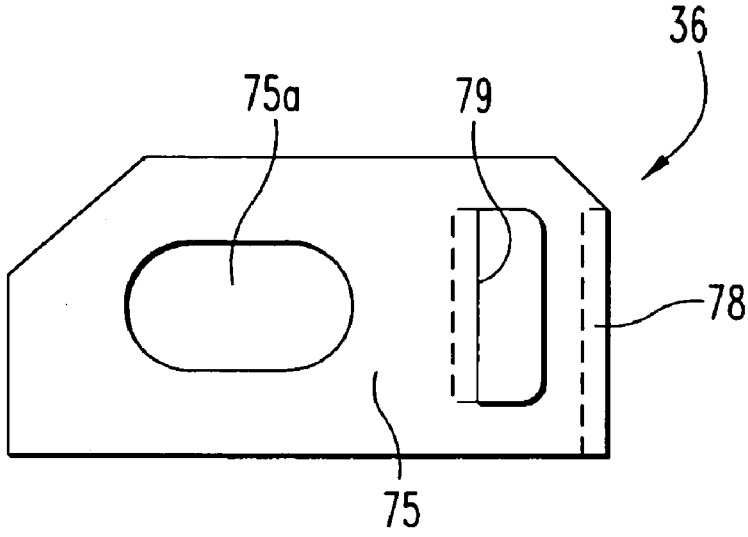
FIG. 17 is a front elevational view of a push button release housing comprising a portion of the FIG. 1 closing ring.
Figure 18:
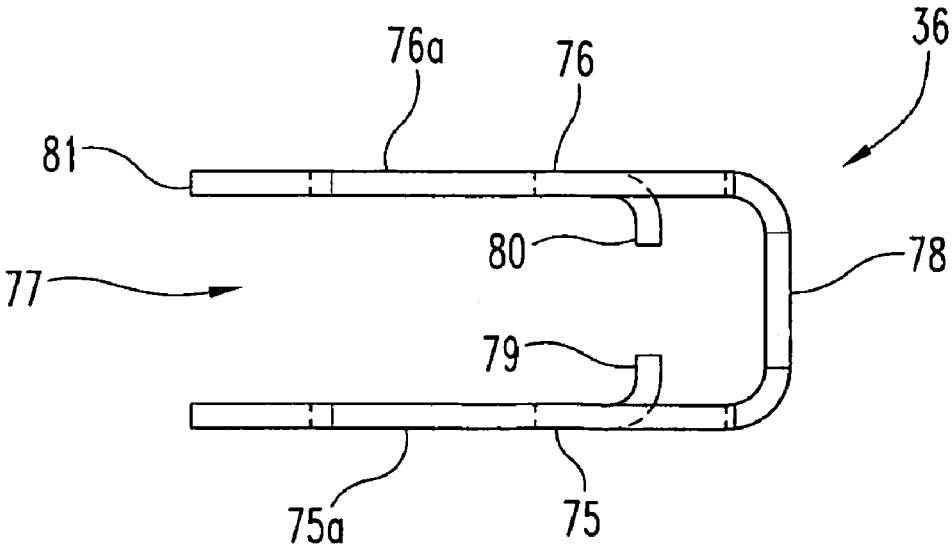
FIG. 18 is a top plan view of the FIG. 17 push button release housing.

With regard to the push button release housing 36, it has been noted that this housing fits down into chamber 61. The detailed construction of housing 36 is illustrated in FIGS. 17 and 18. Housing 36 is a unitary, formed metal component that includes opposing sides 75 and 76 that define interior clearance space 77. The starting flat metal form that results in housing 36 is formed, by bending, so as to create closed end 78. A punching operation enables tabs 79 and 80 to be formed and then subsequently bent inwardly as illustrated in FIG. 17. Each side 75 and 76 defines an oblong clearance slot 75*a* and 76*a*, respectively.

Figure 10:
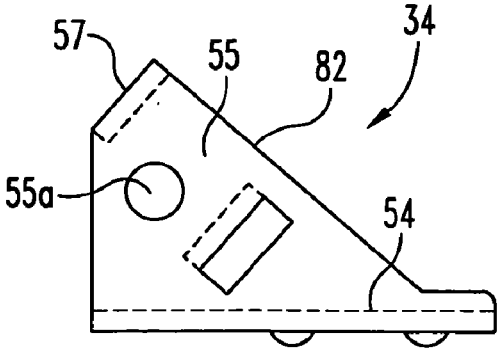
FIG. 10 is a front elevational view of a lever clevis comprising one portion of the FIG. 1 closing ring.
Figure 11:
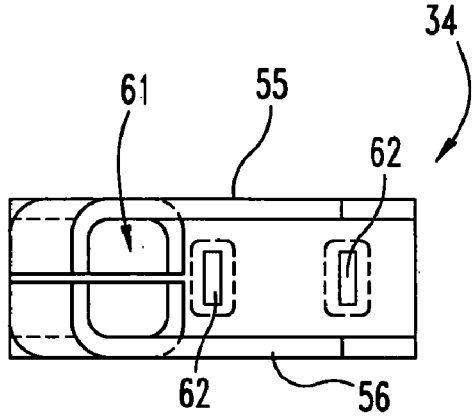
FIG. 11 is a bottom plan view of the FIG. 10 lever clevis.
Figure 12:
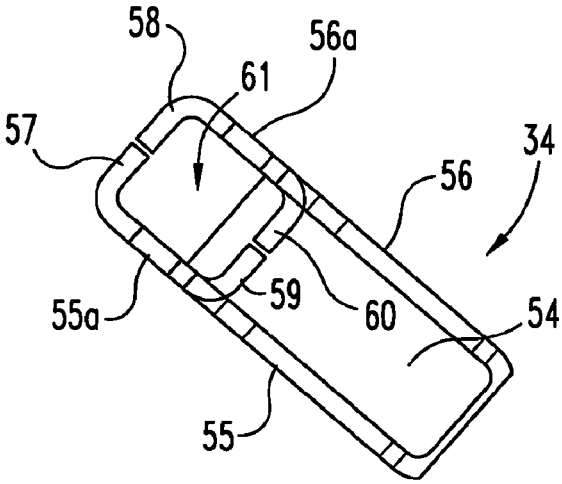
FIG. 12 is a top plan view of the FIG. 10 lever clevis.
Figure 13:
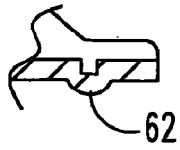
FIG. 13 is an enlarged, front elevational view of a resistance weld projection comprising a portion of the FIG. 10 lever clevis.

In terms of the assembled orientation of housing 36, the open end 81 is inserted into chamber 61 with closed end 78 protruding upwardly beyond the outer (angled) edge 82 of clevis 34 (see FIG. 10). Rivet 40 is inserted through holes 69*a* and 70*a*, through clearance holes 55*a* and 56*a*, and through slots 75*a* and 76*a* for establishing the pivot point connection between lever 35 and clevis 34 as well as for capturing housing 36. Return spring 83 (see FIG. 4) is positioned between rivet 40 and closed end 78. Pushing down on closed end 78 compresses (i.e., shortens) return spring 83 as housing 36 slides inwardly into chamber 61, thereby reducing the height of the portion of housing 36 that otherwise extends above and beyond edge 82. The housing 36 is captured by rivet 40 as it extends through clearance slots 75*a* and 76*a*, thereby enabling the housing 36 to retain its position inside of chamber 61, even though it has sliding push button movement relative to chamber 61.

In operation, we begin with the closing ring 23, specifically the ring body 24, in an open condition as illustrated in FIG. 3, ready to be closed so as to tightly secure lid 22 to container 21 (see FIGS. 1 and 2A). In the FIG. 3 orientation, the tapered end 35*b* of lever 35 is outwardly extending and is to be pulled or pushed in the direction of arrow 86 which is the direction that is toward the outer surface of container 21. As lever 35 is moved, it pulls link 33 and draws the free ends 37 and 38 of ring body 24 closer together. The force required to continue moving lever 35 increases until the cross over or over-center point about rivet 39*a* is reached, at which point the lever 35 snaps down against the outer surface of the closing ring body 24.

As the lever 35 is moving in this closing path direction, edge 71 begins to contact the closed end 78 of housing 36, pushing the housing 36 down slightly into chamber 61. At approximately the same time as the cross over point is reached, the edge 71 clears the closed end 78, allowing the housing 36 to spring return to its normal (extended) position. What occurs is that the housing 36 creates an abutment surface against edge 71, with lever 35 closed, preventing the lever 35 from opening without first pushing housing 36 down, at least partially, into chamber 61. The housing 36 needs to be lowered enough so that edge 71 will clear housing 36 and not abut up against it. By pushing down on housing 36 as the lever 35 is lifted up or pulled outwardly to open, the locking feature using housing 36 is overcome. The process cycle then repeats itself as the closing ring is closed again.

By incorporating the push button locking feature or securing feature created by housing 36 and its spring-biased relationship with lever 35, the lever 35 stays in its closed condition and does not release inadvertently or unintentionally. The use of housing 36 means that any credible risk of lever 35 being caught or hooked or tripped open during handling or shipping is eliminated. These inadvertent or unintentional acts have occurred with prior art closing rings that are constructed and arranged without any type of securing or locking feature. The frequency of occurrence has been high enough to make the design improvement disclosed herein an important advance in the state of the art.

Figure 20:
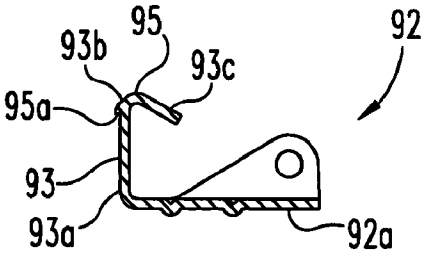
FIG. 20 is a front elevational view, in full section, of the FIG. 19 lever clevis.
Figure 21:
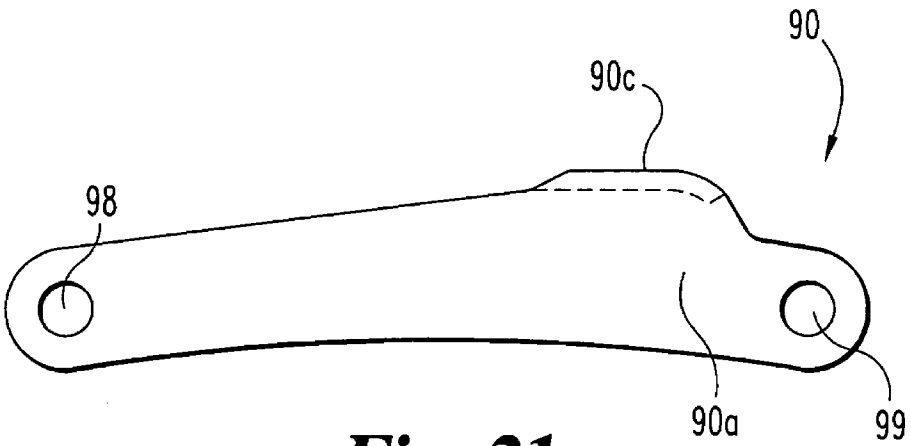
FIG. 21 is a front elevational view of a suitable link for the FIG. 19 lever and lever clevis combination.
Figure 22:
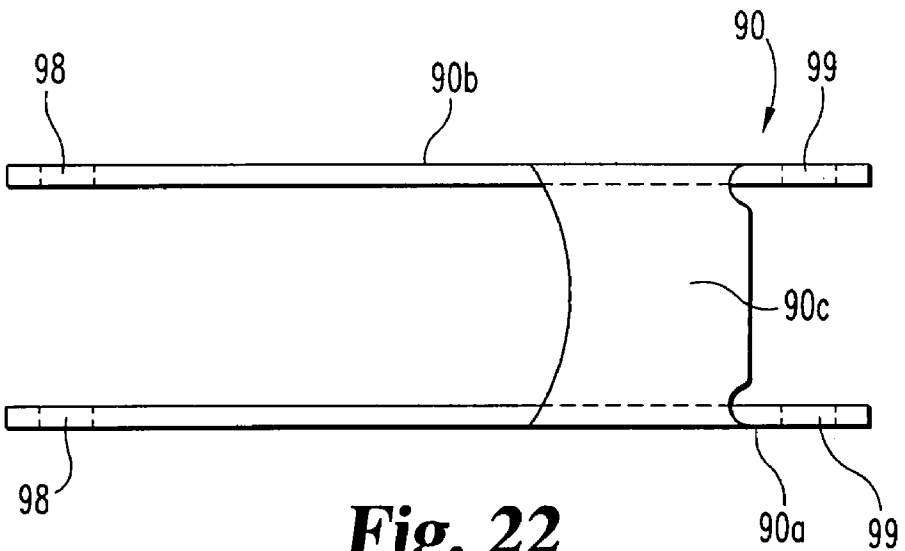
FIG. 22 is a top plan view of the FIG. 21 link.

While the structures of FIGS. 1-18 represent the preferred embodiment of the present invention, three alternative embodiments are illustrated in FIGS. 19-26. The first alternate embodiment is depicted primarily by FIGS. 19 and 20. FIGS. 21 and 22 depict an alternate link 90 configuration, but link 33 is suitable for use with the FIGS. 19 and 20 structure since the pivot point connection distances and locations are the same as that presented as part of the preferred embodiment of FIGS. 1-18.

Figure 19:
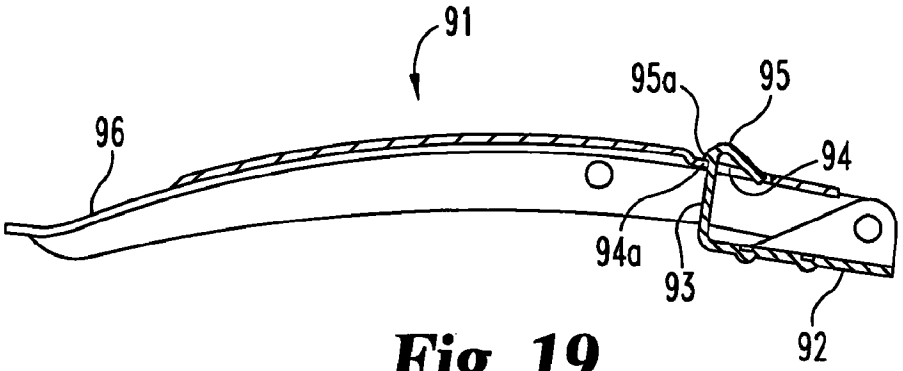
FIG. 19 is a front elevational view, in full section, of a lever and lever clevis combination illustrating an alternate embodiment of the present invention.

Referring to FIGS. 19 and 20, a portion of an alternate closing ring assembly is illustrated and includes lever 91 and lever clevis 92. These two components are configured differently as compared to their counterparts, lever 35 and lever clevis 34, respectively. However, perhaps the most significant change between this alternate embodiment and the preferred embodiment involves the elimination of the push button related housing 36 and the cooperating return spring 83. These components are replaced by a spring release tab 93 that is integrally or unitarily formed as part of the lever clevis 92. In a cooperating manner, the lever 91 is constructed and arranged with an aperture 94 that is sized, shaped, and positioned to receive the upper portion 95, as illustrated in FIG. 19. The aperture 94 includes an inwardly directed locking lip 94*a*. The upper portion 95 of spring release tab 93 includes an outwardly extending locking tab 95*a* that fits over lip 94*a* with a locking, snap-fit assembly. Spring release tab 93 extends from base 92*a* and includes an upright section 93*a*, and upper bend 93*b* and an angled lip 93*c*.

With the lever 91 in a closed and locked condition (FIG. 19), any attempt to open the closing ring by lifting upwardly or outwardly on tapered end 96 causes aperture 94 (lip edge 94*a*) to abut up against the underside surface of locking tab 95*a*. The upper portion 95 is unable to move upwardly due to the construction and arrangement of lever clevis 92 including its assembly to the lever 91 and its welded connection to the closing ring body 24. This cooperative construction prevents any movement of upper portion 95 that would release the lip 94*a* from abutment based solely on lifting up on lever 91. In order to release lever 91, the upper portion 95 must be pushed to the side away from lip 94*a*. The inherent spring properties in the formed metal of spring release tab 93 and its shaping allows it to deflect so as to take the locking tab 95*a* out of the path of lip 94*a*, thereby permitting the lever 91 to be pivoted outwardly to an open condition. The spring release tab 93 functions similar to the push button configuration of housing 36 and return spring 83. The inherent spring quality of spring release tab 93 returns the tab 93 to its FIG. 20 orientation once the lever 91 is pivoted to an open condition.

When the lever 91 is to be closed so as to securely lock the lid onto the container, lever 91 travels toward the container brings aperture 94 into alignment with upper portion 95. This motion also brings lip 94 into contact with the curved upper surface (bend 93*b*) of upper portion 95, pushing against this curved surface. The inherent spring quality allows the upper portion 95 to deflect until lip 94*a* slides over upper portion 95 into locking engagement beneath locking tab 95*a*.

With regard to FIGS. 21 and 22 and the style of unitary link 90, link 90 includes two, spaced-apart side panels 90*a* and 90*b* and a connecting panel 90*c*. Connection panel 90*c* maintains the uniform distance of separation between panels 90*a* and 90*b*. Each side panel defines a pivot location via rivet holes 98 and 99. Link 90 is constructed and arranged to span the width of lever 91 so that side panels 90*a* and 90*b* fit on the outside of lever 91.

Although the configuration of link 90 using connection panel 90*c* permits the use of a single part, it is acceptable to use, instead, two separate links, similar to links 33. The remainder of the assembly configuration, including other parts and connections, is virtually the same for this first alternate embodiment, as has been described for the preferred embodiment of FIGS. 1-18.

Figure 24:
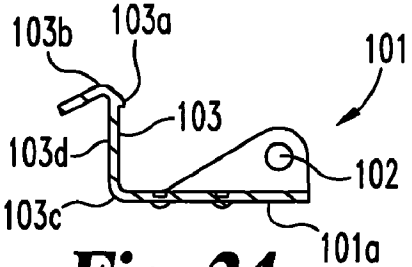
FIG. 24 is a front elevational view, in full section, of the FIG. 23 lever clevis.
Figure 23:
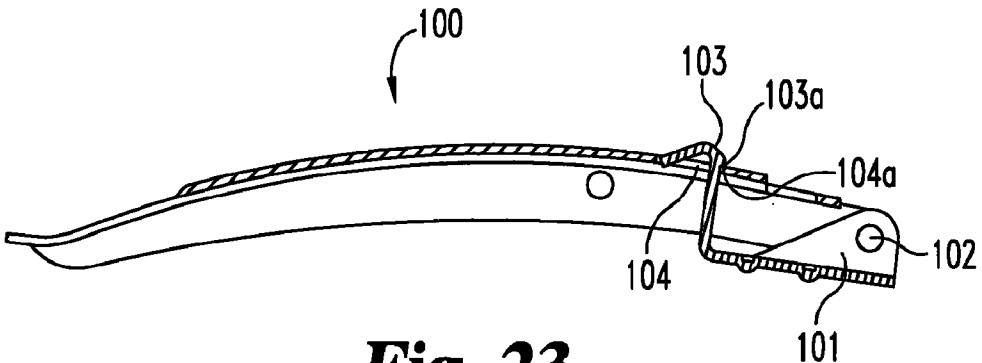
FIG. 23 is a front elevational view, in full section, of a lever and lever clevis combination according to another alternate embodiment of the present invention.
Figure 25:
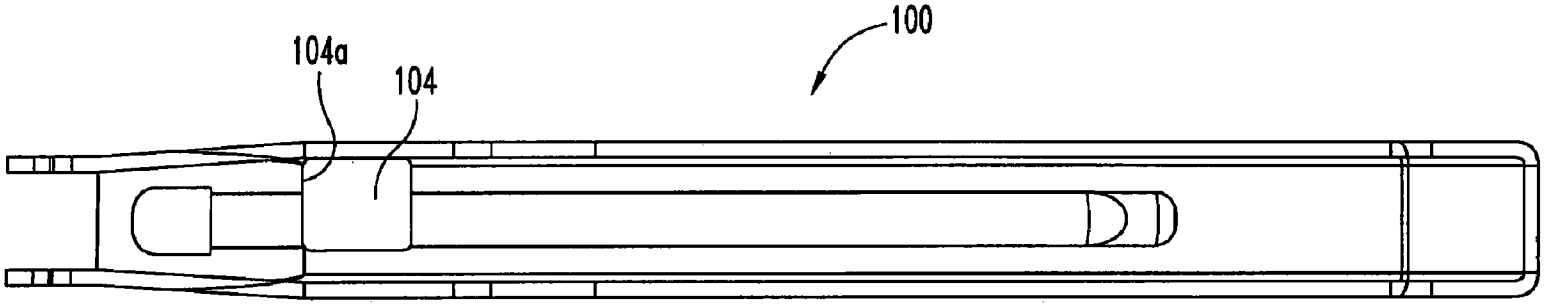
FIG. 25 is a top plan view of the FIG. 23 lever.

The second alternate embodiment is illustrated in FIGS. 23-25. Lever 100 is pivotally connected to lever clevis 101 at pivot location (i.e., rivet hole) 102 by a rivet. The clevis 101 is welded to the outer surface of the closing ring body 24 similar to what has been described for the preferred embodiment of the present invention (FIGS. 1-18). Clevis 101 includes an upper portion 103 that is constructed and arranged to flex as part of the opening and closing of lever 100.

Lever 100 (see FIG. 25) includes a clearance aperture 104 with an inwardly-directed locking lip 104*a* that functions similar to locking lip 94*a*, albeit on the opposite side of aperture 104. The upper portion 103 includes an outwardly-extending locking tab 103*a* that fits over lip 104*a*. The cooperative functioning and engagement between lip 104*a* and locking tab 103*a* during opening and closing of lever 100 is similar to what occurs with lip 94*a* and locking tab 95*a*.

Beginning with the closed and locked condition of FIG. 23, any attempt to open the closing ring by lifting up or outwardly on lever 100 causes the lip 104*a* to abut up against the underside surface of locking tab 103*a*. In order to open the closing ring, it is necessary to push upper portion 103 to the "side" (i.e., circumferentially relative to the container) so as to push tab 103*a* out of engagement with lip 104*a*. Once upper portion 103 is moved to the side in order to take the tab 103*a* out of engagement with lip 104*a*, the lever 100 can be opened. At the time of closing, the lever 100 slides over the upper curved surface (bend 103*b*) of upper portion 103, pushing down on upper portion 103 so as to deflect it the necessary amount for clearance with lever 100, as lever 100 is being closed. When upper portion 103 reaches clearance aperture 104, the upper portion snaps into the aperture due to the inherent spring qualities and the shaping of upper portion 103. As upper portion 103 snaps into aperture 104, locking tab 103*a* snaps over lip 104*a*, resulting in the FIG. 23 lever-locked configuration. Upper portion extends from base 101*a* and begins at bend 103*c* turning into upright section 103*d*.

With regard to a suitable link for use with the configuration of FIG. 23, link 90 can be used or a pair of links 33 can be used. Similarly, link clevis 32 is suitable for link 90 and suitable for whatever link style or combination is selected for use with the components of FIG. 23. In each of the described embodiments, the various welded connections of the clevis members to the free ends of the closing ring body 24 are virtually the same, the rivet hole (pivot connection) sizes and locations are virtually the same and the link and lever lengths are virtually the same.

Figure 26:
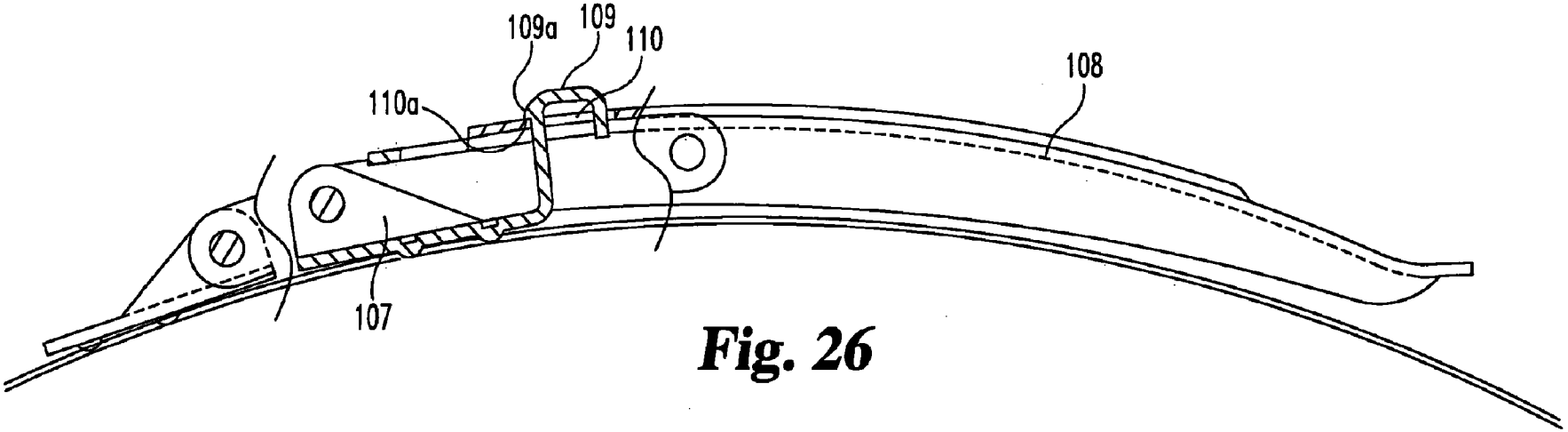
FIG. 26 is a front elevational view, in full section, of a lever and lever clevis combination according to another alternate embodiment of the present invention.

The third alternate embodiment is illustrated in FIG. 26. Due to the similarities in all three alternate embodiments, it is sufficient here to show only the side elevational view, in partial section, of lever clevis 107 and cooperating lever 108. The upper portion 109 of clevis 107 is shaped with two bends so as to provide a generally inverted U-shape to the portion or part that extends up through lever aperture 110. Similar to the description and functioning of the other upper portions 95 and 103, there is sufficient spring in the formed and shaped metal, relative to its weld location, to permit upper portion 109 to be moved manually to "unlock" lever 108 from its closed condition.

Similar to the other two alternate embodiments, upper portion 109 includes an outwardly protruding locking tab 109*a* and lever aperture 110 defines a cooperating locking lip 110*a*. In the snapped closed, locked condition, the locking tab 109*a* overlaps the upper surface of locking lip 110*a*. Any attempt to open lever 108 causes upward movement by locking lip 110*a* and it abuts up against locking tab 109*a*. In order to "unlock" the lever 108, it is necessary to move the upper portion 109 so that the upwardly moving (pivoting) locking lip 110*a* will clear the locking tap 109*a*. This can be done manually.

In order to close and lock lever 108, simply close (collapse) the lever 108 against the ring body in the normal manner. Although the lever 108 will abut up against upper portion 109, the angle of engagement permits the lever 108 to push the upper portion 109 out of position until aperture 110 is encountered, at which point the upper portion 109 snaps into aperture 110, as is illustrated in FIG. 26.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A closing ring for a container and lid combination for securing the lid to an open end of said container, said closing ring comprising:

a ring body having a first free end and a second free end, wherein said first and second free ends are drawn toward each other as part of manipulating said closing ring to secure said lid to said container;

a lever pivotally connected at a first end to said first end of said ring body at a first pivot axis, said lever being constructed and arranged for opening and closing said ring body by pivoting about said first pivot axis;

a link pivotally connected at a first end to said second end of said ring body and pivotally connected at a second end to said lever; a movable projection assembled to said first end of said ring body, said movable projection being constructed and arranged for engaging said lever during an opening attempt, said engaging preventing opening of said ring body until said movable projection is moved out of its engaging position relative to said lever;

a first abutment fixed in position with respect to said lever; and biasing means, wherein said movable projection includes a second abutment and wherein said biasing means is positioned between said first and second abutments and said second abutment being movable relative to said first abutment.

2. The closing ring of claim 1 wherein said lever is connected to the first end of said ring body by connection to a lever clevis member that is joined to said first end.

3. The closing ring of claim 2 wherein the connection of said lever and said lever clevis member includes a lever pivot member that is inserted through said lever clevis member and through said lever.

4. The closing ring of claim 3 wherein said link is connected to the second end of said ring body by connection to a link clevis member that is joined to said second end.

5. The closing ring of claim 3 wherein said lever pivot member provides said first abutment.

6. The closing ring of claim 2 wherein said lever clevis member is constructed and arranged with a receiving chamber that receives said biasing means and said movable projection, said movable projection being movable into said receiving chamber for moving said movable projection out of its engaging position with said lever.

7. The closing ring of claim 2 wherein said movable projection is assembled into said lever clevis member.

8. The closing ring of claim 7 wherein said lever having a receiving opening and said movable projection having an upper portion that extends through said receiving opening.

9. The closing ring of claim 8 wherein said receiving opening having an engaging edge and said upper portion including a locking tab that engages said engaging edge for establishing said engaging position for preventing opening of said ring body.

10. The closing ring of claim 1 wherein biasing means includes a spring.

11. The closing ring of claim 1 wherein said link is connected to the second end of said ring body by connection to a link clevis member that is joined to said second end.

12. The closing ring of claim 11 wherein the connection of said link and said link clevis member includes a link pivot member that is inserted through said link clevis member and through said link.

13. A closing ring for a container and lid combination for securing the lid to an open end of said container, said closing ring comprising:

a ring body having a first free end and a second free end, wherein said first and second free ends are drawn toward each other as part of manipulating said closing ring to secure said lid to said container;

a lever pivotally connected at a first end to said first end of said ring body at a first pivot axis, said lever being constructed and arranged for opening and closing said ring body by pivoting about said first pivot axis;

a link pivotally connected at a first end to said second end of said ring body and pivotally connected at a second end to said lever;

a movable projection assembled to said first end of said ring body, said movable projection being constructed and arranged for engaging said lever during an opening attempt, said engaging preventing opening of said ring body until said movable projection is moved out of its engaging position relative to said lever; and a spring, wherein said movable projection is spring-biased by said spring, and wherein said lever clevis member is constructed and arranged with a receiving chamber that receives said spring and said movable projection, said movable projection being movable into said receiving chamber for moving said movable projection out of its engaging position with said lever.

14. A closing ring for a container and lid combination for securing the lid to an open end of said container, said closing ring comprising:

a ring body having a first free end and a second free end, wherein said first and second free ends are drawn toward each other as part of manipulating said closing ring to secure said lid to said container;

a lever pivotally connected at a first end to said first end of said ring body at a first pivot axis by a lever pivot member, said lever being constructed and arranged for opening and closing said ring body by pivoting about said first pivot axis;

a link pivotally connected at a first end to said second end of said ring body and pivotally connected at a second end to said lever;

a movable projection assembled to said first end of said ring body, said movable projection being constructed and arranged for engaging said lever during an opening attempt, said engaging preventing opening of said ring body until said movable projection is moved out of its engaging position relative to said lever; and a spring positioned between said lever pivot member and said movable projection and being constructed and arranged for acting against said lever pivot member, said movable projection being spring-biased by said spring.

* * * * *